United States Patent [19]

Swan

[11] Patent Number: 4,668,854

[45] Date of Patent: May 26, 1987

[54] HUMIDIFICATION SYSTEM

[75] Inventor: Alan J. Swan, Portland, Oreg.

[73] Assignee: NAPCO Scientific Company, Tualatin, Oreg.

[21] Appl. No.: 765,139

[22] Filed: Aug. 13, 1985

[51] Int. Cl.[4] ..... F22B 1/28

[52] U.S. Cl. ..... 219/273; 219/275; 219/362; 236/44 R; 122/40

[58] Field of Search ..... 219/271, 272, 273, 274, 219/255, 362; 126/113; 236/44 R, 44 A, 44 C; 261/DIG. 15, DIG. 34, DIG. 65; 122/40, 41; 165/21, 3

[56] References Cited

U.S. PATENT DOCUMENTS

| | | | |
|---|---|---|---|
| 1,828,702 | 10/1931 | Foo | 219/273 |
| 2,133,958 | 10/1938 | Kalischer | 62/2 |
| 2,184,685 | 12/1939 | Brace | 119/37 |
| 2,504,278 | 4/1950 | Read | 236/44 |
| 2,663,500 | 12/1953 | Holtzclaw | 236/44 A |
| 3,212,492 | 10/1965 | Himmerich | 126/113 |
| 3,289,936 | 12/1966 | Coburn | 236/44 |
| 3,410,986 | 11/1968 | Groom | 122/40 |
| 3,424,231 | 1/1969 | Truhan | 165/19 |
| 3,637,977 | 1/1972 | Folke | 219/362 |
| 4,146,775 | 3/1979 | Kirchner | 219/295 |
| 4,262,191 | 4/1981 | Lepper | 236/44 A |
| 4,361,273 | 11/1982 | Levine | 126/113 |
| 4,408,116 | 10/1983 | Turner | 122/40 |
| 4,499,031 | 2/1985 | Sexton | 236/44 C |

FOREIGN PATENT DOCUMENTS

| | | | |
|---|---|---|---|
| 1065465 | 10/1979 | Canada | 219/273 |
| 174770 | 1/1935 | Switzerland | 122/40 |

*Primary Examiner*—E. A. Goldberg
*Assistant Examiner*—Teresa J. Walberg
*Attorney, Agent, or Firm*—Dellett, Smith-Hill, and Bedell

[57] ABSTRACT

The humidity within a chamber is controlled by injecting pulses of steam therein, the duty cycle of the steam pulse input being increased when the humidity of the chamber is lower than desired and decreased when the humidity of the chamber is higher than desired. Each steam pulse is generated by injecting a pulse of water through a small inlet tube into a steam generator comprising a tank surrounded by a band heater, the tank being preheated to a high temperature such that the water quickly turns to steam as it is injected. The steam is then vented into the aforementioned chamber. A detector, mounted within the chamber, produces a signal of magnitude proportional to the relative humidity in the chamber and this signal is input to a control circuit for producing a pulse width modulated control signal of duty cycle varying with the difference between the magnitude of the humidity sensor signal and an adjustable set point signal. The control signal opens and closes a solenoid valve which effects the injection of water into the steam generator.

8 Claims, 4 Drawing Figures

HUMIDIFICATION SYSTEM

BACKGROUND OF THE INVENTION

The present invention relates to humidifiers and more particularly to a method and apparatus for controlling the humidity in a chamber.

Humidifiers of various types are known. Some, which may be termed evaporative humidifiers, depend largely or entirely on relative movement between air to be humidified and a water bearing surface. These include, for example, units wherein water is thrown from a high speed rotating wheel and rapidly enters the atmosphere as finely divided droplets, or wherein a moving air stream is directed past or through water bearing screens or porous members. Disadvantages of these humidifiers include the undesirable distribution of water droplets carrying dust, bacteria and other contaminates from the water supply. Also, frequent cleaning maintenance is required not only for the evaporation unit itself but also for the environmental surfaces contacted by the thus humidified air.

Humidifiers of another type humidify by heating water to generate steam for admission to the atmosphere. Minerals in the water supply remain in the heated water reservoir and are not admitted to the humidified air. Moreover the boiling of the supply water to produce steam substantially kills bacteria, and therefore a clean, sterile water vapor is distributed to the environment.

One problem associated with boiling a quantity of water relates to the long lead time taken to increase the amount of water vapor generated and the long lead time required to stop the flow of water vapor when no longer needed. Thus such systems are not well adapted to precise control of humidity, particularly in a small chamber wherein only small amounts of water vapor are to be added in order to achieve a proper humidity level.

SUMMARY OF THE INVENTION

According to one aspect of the invention, the humidity of a chamber is changed by injecting pulses of steam. The duty cycle of the steam pulse input is increased when the humidity of the chamber is lower than desired and decreased when the humidity of chamber is higher than desired. The extent of humidity increase or decrease is precisely controlled.

According to another aspect of the invention, each steam pulse is generated by injecting a pulse of water through a small inlet tube into a steam generator comprising a tank surrounded by a band heater. The unit is preheated to a high temperature such that the water quickly turns to steam as it is injected and the steam is then vented to the humidified chamber. Use of the small water inlet tube minimizes the amount of water remaining therein between water injection pulses, thereby reducing the amount of water trickling into the boiler between injections. Delays in starting and stopping steam pulses due to the time required to fill or drain the inlet tube are reduced and control over steam injection is improved.

According to a further aspect of the invention, a detector mounted within the chamber produces a signal of a magnitude which is proportional to the relative humidity in the chamber. A control circuit produces a pulse width modulated control signal of a duty cycle which varies with the difference between the magnitude of the humidity sensor signal and an adjustable set point signal. In a preferred embodiment of the invention, this control signal is utilized to control the injection of water into the steam generator by opening and closing a solenoid valve, while in an alternative embodiment of the invention, water is injected into the steam generator by a pump and the control signal is utilized to start or stop the pump.

It is accordingly an object of the present invention to provide a new and improved humidification system wherein the humidity within a chamber is closely controlled.

It is another object of the present invention to provide a new and improved humidification system which is compact and uses a minimum of energy.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

FIG. 1 is a diagram of the humidity control system of the present invention, FIG. 2 is a diagram showing the steam generation duty cycle of the humidity control system of FIG. 1 with respect to the humidity in the chamber of FIG. 1, FIG. 3 is a combination block and schematic diagram of a control circuit for the humidity control system of FIG. 1, and FIG. 4 is a diagram showing the relationship between signal voltages in the circuit of FIG. 3.

DETAILED DESCRIPTION

Figure 1:
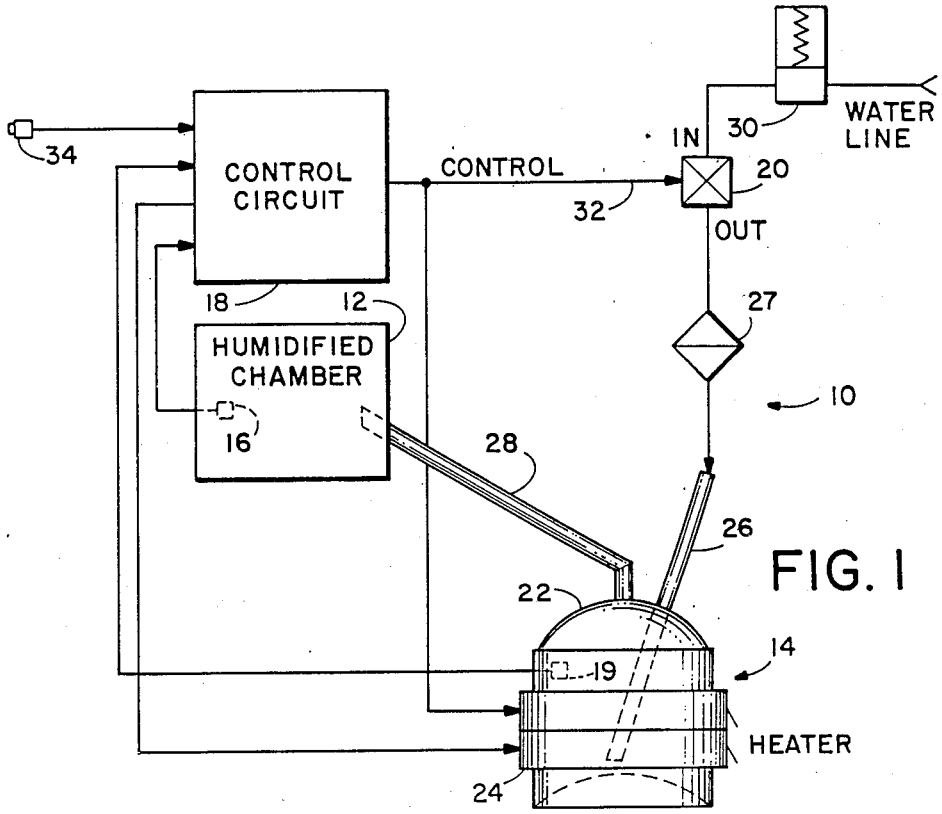

Referring to FIG. 1 there is depicted in diagram form a control system 10 according to the present invention, adapted to maintain humidity within chamber 12 at a desired level by injecting steam therein at a variable rate. System 10 comprises a steam generator 14, a relative humidity sensor 16, a control circuit 18, and a solenoid operated valve 20.

Steam generator 14 comprises a boiler tank 22 surrounded by a band heater 24. Regular pulses of water are injected into the tank through an inlet tube 26. Tank 22 is cylindrically shaped, having an upwardly domed top and an upwardly domed bottom such that any water condensing on the top or the bottom tends to run towards the sides of the tank where the band heater is mounted, thereby facilitating boiling of the water. Band heater 24 is electrically heated by two heating coils wherein a first heating coil 23 is thermostatically operated to maintain tank 22 at a relatively high temperature (e.g. 200 degrees C.) and wherein a second heating coil 25 operates only when water is being injected into the tank 22 and is sized to provide enough heat energy to convert the injected water to steam without changing the temperature in the tank. Thus the two coils in band heater 24 operate together to maintain a substantially constant temperature in the tank over a wide range of water pulse duty cycles.

As a water pulse enters tank 22 it rapidly turns to steam which then vents through an outlet pipe 28 and enters chamber 12 in the form of a steam pulse. The ratio of the duration of a water pulse to the duration of a total water pulse on/off cycle comprises the "duty cycle" of the water pulse input to the boiler tank. The duration of the steam pulse and therefore the quantity of steam injected into the chamber during each steam pulse cycle is controlled by controlling the duty cycle of the water pulses.

The diameter and length of inlet tube 26 is made relatively small whereby the amount of water remaining in the tube between water injection pulses is small to minimize the amount of water trickling into the tank 22 between water injections. Delays in starting and stopping steam pulses due to the time required to fill or drain the inlet tube 26 are reduced, improving control over steam injection turn on and turn off.

In the preferred embodiment, for a humidifying chamber of 30 cubic feet or less, tank 22 is approximately one and one-half inches in diameter and one inch tall. Inlet tube 28 is approximately one-sixteenth inch in diameter while outlet tube 26 is approximately 0.25 inch in diameter. Water is supplied to inlet tube 26 at about 20 psi.

Water pulses are applied to inlet tube 26 through a filter 27 by opening and closing a solenoid operated valve 20 coupled to a water supply line through a pressure regulator 30. Valve 20 is opened and closed by energizing and de-energizing control line 32 from control circuit 18. Relative humidity sensor 16, mounted within chamber 12, generates an indicating signal proportional to the humidity in chamber 12 while a set point control 34 provides another signal of magnitude which is manually adjustable by an operator. Control circuit 18 compares the sensor indicating signal with the set point signal and energizes and de-energizes the control line 32 at a duty cycle varying in accordance with the difference between the two signals.

Figure 2:
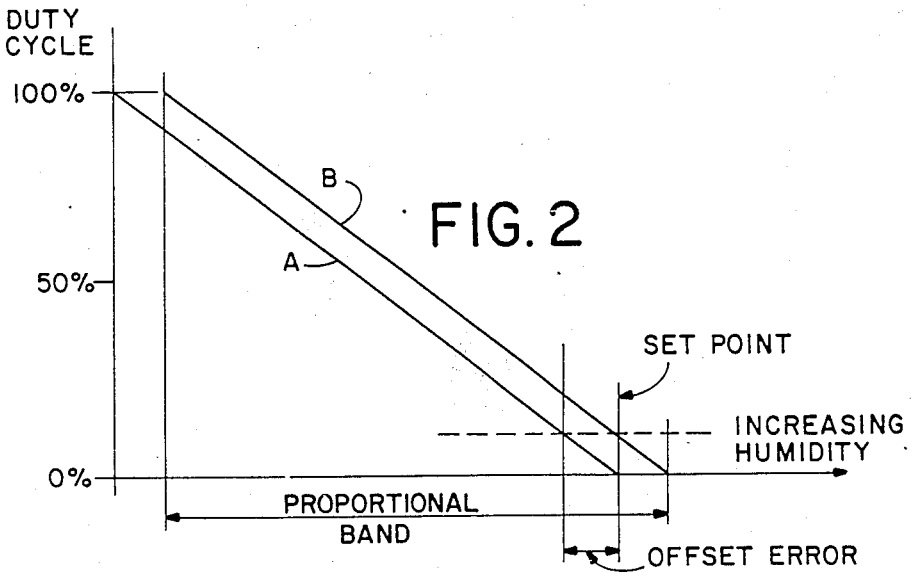

FIG. 2 is a diagram plotting the duty cycle of the control line 32 with respect to humidity as indicated by the magnitude of the humidity sensor 16 indicating signal. Line A shows an ideal control line 32 "duty cycle" response for a chamber having no humidity losses. When the humidity in chamber 12 is sufficiently high, the sensor indicating signal is higher than the set point indicating signal, and the "duty cycle" of control line 32 is zero percent, i.e. line 32 is continuously de-energized. In such case valve 20 remains closed, allowing no water to be injected into steam generator 14 and no steam is generated. When the humidity in chamber 12 is very low, the sensor 16 indicating signal is lower in magnitude than the set point signal and outside a "proportional band", whereby the "duty cycle" on control line 32 is 100 percent, i.e. line 32 is continuously "on". In this case valve 20 stays open continuously and steam is continuously injected from tank 22 into chamber 12. When the sensor indicating signal magnitude is lower than the set point value, and within the proportional band, the duty cycle of control line 32 varies linearly with the difference between the sensor and set point indicator signals. When the system operates in the proportional band, pulses of water injected into steam generator 14 cause pulses of steam to be injected into chamber 12. The duration of each water or steam pulse increases as humidity within the chamber 12 decreases.

Most humidity control chambers experience humidity losses, so the steam generator 14 must continually inject compensating amounts of steam into chamber 12 in order to maintain a selected humidity level. Therefore the chamber humidity will reach equilibrium at a humidity sensor 16 signal level somewhat lower than the set point level, the difference comprising an "offset error". To eliminate the offset error, control circuit 18 includes means to shift its duty cycle response shown by line A in FIG. 2 to that of line B in FIG. 2. With such a "reset shift", the humidity sensor will provide a sensor indicating signal equal to the set point indicator signal when the humidity of the chamber reaches equilibrium. In this way the set point indicating signal can be easily calibrated to match the response of the humidity sensor.

Figure 3:
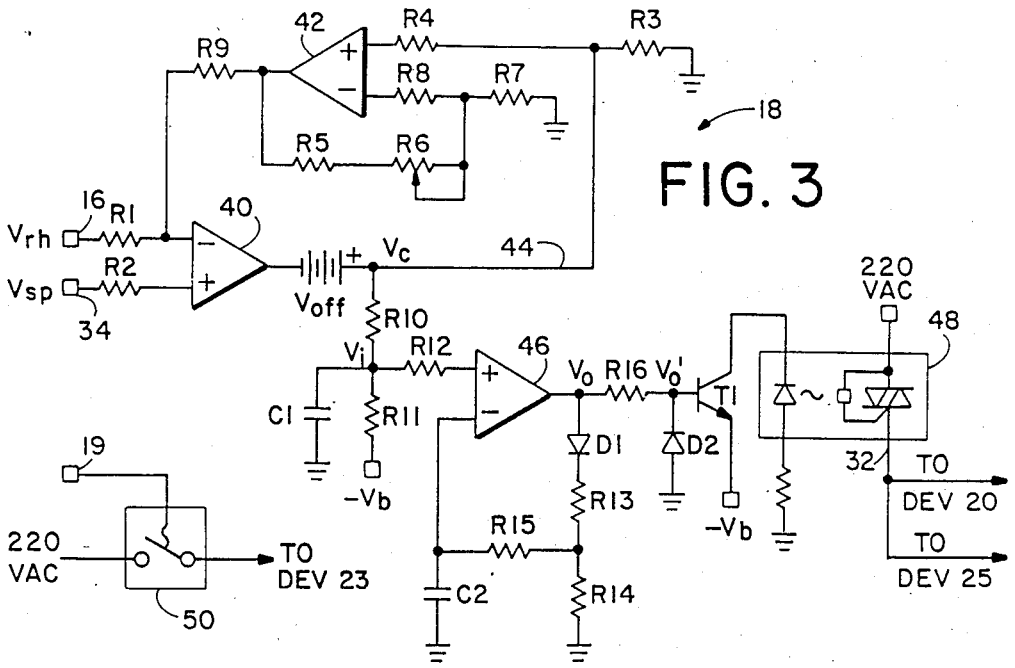

FIG. 3 is a combined block and schematic diagram of control circuit 18 of FIG. 1. The relative humidity sensor 16 indicating signal Vrh is applied to an inverting input of a differential amplifier 40 through a resistor R1 while the set point signal Vsp is applied to a noninverting input of amplifier 40 through another resistor R2. The output voltage of amplifier 40 is increased by an offset voltage Voff, to form a control voltage Vc at a node 44 connected to ground through a resistor R3. The Vc voltage developed across R3 is applied to a noninverting input of another differential amplifier 42 through another resistor R4. The output of differential amplifier 42 is developed across series connected resistor R5, variable resistor R6, and resistor R7 and is applied through a resistor R9 to the inverting input of amplifier 40. The signal at the junction of resistors R7 and R6 is fed back through a resistor R8 to an inverting input of amplifier 42.

The magnitude of the level shifted amplifier 40 output signal Vc is inversely proportional to the magnitude of the humidity indicating signal Vrh, the constant of proportionality being determined by the gain G of amplifier 40. The gain of amplifier 40 is controlled by the gain of amplifier 42 which is in turn controlled by adjustment of variable resistor R6. When R6 is set to a small resistance value, the negative feedback associated with amplifier 42 is large, and the gain of amplifier 42 is small. Since the amplifier 42 is in a negative feedback path of amplifier 40, a reduction in amplifier 42 gain causes an increase in amplifier 40 gain. Conversely, a decrease in amplifier 42 gain causes an increase in amplifier 40 gain. Therefore the gain of amplifier 40 is controlled by adjustment of resistor R6.

A pair of series connected resistors R10 and R11 link node 44 to a negative DC power supply Vb. Resistors R10 and R11 act as a voltage divider to produce a voltage Vi at the junction of R10 and R11 which is applied to a non-inverting input of an amplifier 46 through a resistor R12. A capacitor C1, connected between the R10 and R11 junction and ground, shunts AC noise appearing in the Vi signal away from amplifier 46. A diode D1 and a pair of resistors R13 and R14 connect the output of amplifier 46 to ground. Resistors R13 and R14 divide the amplifier 46 output voltage Vo and feed it back through a resistor R15 to an inverting input of amplifier 46. The inverting input of amplifier 46 is also returned to ground through a capacitor C2. The RC feedback to amplifier 46 causes output voltage Vo to oscillate with a fixed frequency according to the time constant of the RC feedback network. Vo oscillates about a voltage level proportional to Vi with a peak-to-peak voltage independent of Vi.

Vo is applied to the base of an NPN transistor T1 through a resistor R16. The negative excursion of the voltage Vo' at the base of T1 is limited by a diode D2 having its cathode connected to the base of T1 and its anode connected to ground. The emitter of T1 is connected to a negative voltage while the collector of T1 is connected to the control input of a switch means 48 suitably comprising an optical coupling device. When T1 turns on, its collector current activates coupling device 48, causing the device to apply a 220 VAC supply to control line 32, thereby opening valve 20 and injecting water into the steam generator tank.

Figure 4:
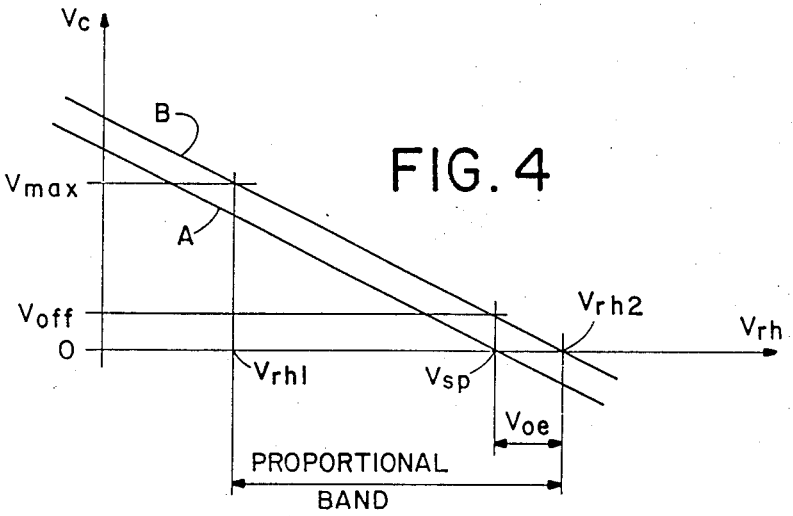

FIG. 4 is a diagram plotting the relation between control voltage Vc and the humidity sensor output voltage Vrh. Line A of FIG. 4 plots Vc as a function of Vrh when the offset voltage Voff is zero, while line B plots Vc as a function of Vrh when Voff is non-zero. An increase in Voff shifts line B upward from line A, the slopes of each line being the same and corresponding to the gain G of amplifier 40. Line A crosses the Vrh axis at the setpoint voltage Vsp, since the output voltage of amplifier 40 is zero when Vsp is equal to Vrh. With line B shifted upward by Voff, line B crosses the Vrh axis to the right of Vsp by an offset error voltage Voe. The magnitude of Voff is appropriately selected to account for the normal humidity losses of the chamber, so the system operates according to line B.

When the humidity in the chamber is at the desired level, Vrh is equal to Vsp and Vc is equal to Voff. Resistors R10 and R11 are sized so that Vi is negative but close enough to zero so that the peaks of the oscillating Vo' signal are high enough above zero to turn on transistor T1 long enough to cause generation of steam pulses of sufficient duration to make up for the anticipated natural humidity losses of the chamber.

When the humidity in the chamber exceeds the desired level, Vrh rises to a point Vrh2 where Vc falls to 0 volts, pulling Vo' down so that it does not rise high enough above zero during any part of its cycle to turn on transistor T1. The steam pulse duty cycle is therefore 0% and the humidity in the chamber will fall due to the natural humidity losses of the chamber.

When the humidity in the chamber falls below the desired set point level, Vc rises proportionately, driving Vi more positive, causing longer portions of the oscillating Vo' signal to rise above the level necessary to turn on transistor T1, thereby increasing the duty cycle of steam generation. When the system operates in the proportional band, the humidity level in the chamber rises at a rate inversely proportional to the humidity in the chamber. When the relative humidity is very low, Vrh falls to a level Vrh1 and Vc attains a level Vmax at which the resulting Vo' is sufficiently above zero during all portions of its oscillation cycle to continuously maintain transistor T1 in its on state, thereby causing continuous injection of steam into the chamber at a 100% duty cycle.

The proportional band in which the steam injection duty cycle is inversely proportional to the relative humidity in the chamber thus extends from Vrh1 to Vrh2. This proportional band may be increased by adjusting resistor R6 of FIG. 3 to lower the gain of amplifier 40, thereby decreasing the slope of line B of FIG. 4 so that Vrh1 and Vrh2 are spaced farther apart. Conversely, the proportional band may be decreased by increasing the gain of amplifier 40, increasing the slope of line B so that Vrh1 and Vrh2 are moved closer together. The narrower the proportional band, the faster the response of the system to a humidity disturbance in the chamber. However if the proportional band is set too narrow, the ability of the system to maintain precise humidity control is impaired due to overcompensation effects.

Referring again to FIG. 3, the first coil 23 of the band heater 24 is energized by a 220 VAC source through a thermostat 50 when the temperature in the steam generator tank as detected by sensor 19 falls below 200 degrees centigrade. Coil 23 therefore operates to maintain the boiler tank at a constant temperature. The second coil 25 of the band heater is connected to the 220 VAC source by switch means 48 at the same time valve 20 is connected to the 220 VAC source so that the second band heater is energized whenever the valve is opened, thereby applying additional heat to the boiler whenever water is injected therein to assist coil 23 in maintaining constant tank temperature.

The humidity control system 10 of the present invention closely controls the humidity of chamber 12 by injection of steam pulses of duration controlled according to the difference between a set point signal and a humidity sensor signal. The apparatus implementing the humidification system can be made quite small in proportion to the size of the chamber 12 and can be easily insulated to prevent undue heat loss.

While a preferred embodiment of the present invention has been shown and described, it will be apparent to those skilled in the art that many changes and modifications may be made without departing from the invention in its broader aspects. For instance, in an alternative embodiment valve 20 may be replaced by a pump which starts or stops according to the variable duty cycle signal of control line 32. Further, the voltage source of FIG. 3 could be AC or DC depending on the requirements of the heater coils or valve selected. The appended claims are therefore intended to cover all such changes and modifications as fall within the true spirit and scope of the invention.

I claim:

1. An apparatus for maintaining a constant humidity in a chamber comprising:

a tank having an inlet and an outlet, said outlet connecting said tank to said chamber;

means to maintain said tank at a substantially constant temperature;

means to inject water into said tank in cyclical pulses such that steam is forced out of said tank through said outlet and into said chamber in corresponding cyclical pulses; and humidity sensing means mounted within said chamber, said injection means being responsive to said humidity sensing means, said pulses having a duty cycle which varies in inverse relation to the difference between the measured humidity within said chamber and desired humidity.

2. An apparatus as in claim 1 wherein said injection means comprises a valve which opens or closes in response to an applied electrical signal.

3. An apparatus as in claim 1 wherein said injection means comprises a pump which starts or stops in response to an applied electrical signal.

4. A steam generator comprising:

a tank having an inlet and an outlet, a temperature sensor mounted in said tank, means responsive to said temperature sensor to maintain said tank at a constant temperature, means to increase the heat applied to said tank such that, for water injected into said tank through said inlet, the applied heat is sufficient to convert the injected water into steam and force said steam through said outlet, and means to inject said water into said tank in variable duty cycle pulses such that the steam is forced out of said tank through said outlet in corresponding variable duty cycle pulses.

5. A steam generator as in claim 4 wherein said tank is cylindrical in shape and including heating means comprising a cylindrically shaped electrical heating element surrounding said tank.

6. A steam generator as in claim 4 wherein said tank has a domed shaped top and bottom.

7. An apparatus for maintaining a constant humidity in a chamber comprising:

a tank having an inlet and an outlet, said outlet connecting said tank to said chamber.

means to heat said tank such that as water is injected into said tank through said inlet said water is turned into steam and forced out said outlet, humidity sensing means mounted within said chamber, and means responsive to said humidity sensing means to inject said water into said tank in cyclical pulses, said pulses having a duty cycle which varies in inverse relation to the humidity within said chamber.

8. A method of maintaining humidity in a chamber comprising the steps of:

a. measuring the humidity in the chamber;

b. injecting water into a boiler in cyclical pulses, said pulses having a duty cycle which varies in inverse relation to the difference between desired humidity and the measured humidity within said chamber, said boiler converting said water pulses into steam pulses; and c. injecting said steam pulses into said chamber.

* * * * *

UNITED STATES PATENT AND TRADEMARK OFFICE

CERTIFICATE OF CORRECTION

PATENT NO. : 4,668,854

DATED : May 26, 1987

INVENTOR(S) : Alan J. Swan

It is certified that error appears in the above-identified patent and that said Letters Patent is hereby corrected as shown below:

Column 8, line 6, "of" should be --for--.

Signed and Sealed this

Twenty-second Day of September, 1987

*Attest:*

DONALD J. QUIGG

*Attesting Officer* *Commissioner of Patents and Trademarks*